US006705264B2

(12) United States Patent
Onoue

(10) Patent No.: US 6,705,264 B2
(45) Date of Patent: Mar. 16, 2004

(54) VALVE CONTROL FOR OUTBOARD MOTOR ENGINE

(75) Inventor: Akihiro Onoue, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 48 days.

(21) Appl. No.: 09/899,519

(22) Filed: Jul. 3, 2001

(65) Prior Publication Data

US 2002/0017252 A1 Feb. 14, 2002

Related U.S. Application Data

(63) Continuation-in-part of application No. 09/470,845, filed on Dec. 23, 1999, now abandoned.

(30) Foreign Application Priority Data

Dec. 24, 1998 (JP) ..... 10-365909

(51) Int. Cl.[7] ..... F01L 1/18

(52) U.S. Cl. ..... 123/90.39; 123/90.16; 123/90.27

(58) Field of Search ..... 123/90.15, 90.16, 123/90.17, 90.27, 90.39; 74/559, 567, 569

(56) References Cited

U.S. PATENT DOCUMENTS

| | | | | | |
|---|---|---|---|---|---|
| 5,184,581 | A | | 2/1993 | Aoyama et al. | 123/90.31 |
| 5,230,317 | A | * | 7/1993 | Nonogawa et al. | 123/432 |
| 5,233,948 | A | | 8/1993 | Boggs et al. | 123/64 |
| 5,460,130 | A | | 10/1995 | Fukuzawa et al. | 123/90.15 |
| 5,592,907 | A | | 1/1997 | Hasebe et al. | 123/90.15 |
| 5,704,315 | A | | 1/1998 | Tsuchida et al. | 123/90.16 |
| 5,769,044 | A | | 6/1998 | Moriya | 123/90.17 |
| 5,785,017 | A | * | 7/1998 | Saito et al. | 123/90.16 |
| 5,799,631 | A | | 9/1998 | Nakamura | 123/90.17 |
| 5,809,953 | A | * | 9/1998 | Saito et al. | 123/90.16 |
| 5,924,396 | A | | 7/1999 | Ochiai et al. | 123/90.16 |
| 5,954,019 | A | | 9/1999 | Yoshikawa et al. | 123/90.17 |
| 5,988,126 | A | | 11/1999 | Strauss et al. | 123/90.12 |
| 6,032,629 | A | | 3/2000 | Uchida | 123/90.34 |
| 6,035,817 | A | | 3/2000 | Uchida | 123/90.17 |
| 6,053,135 | A | * | 4/2000 | Ochiai et al. | 123/90.16 |
| 6,076,492 | A | | 6/2000 | Takahashi | 123/90.17 |
| 6,135,077 | A | | 10/2000 | Moriya et al. | 123/90.17 |
| 6,186,105 | B1 | | 2/2001 | Yonezawa | 123/90.17 |
| 6,250,266 | B1 | | 6/2001 | Okui et al. | 123/90.17 |

FOREIGN PATENT DOCUMENTS

| | | | | |
|---|---|---|---|---|
| DE | 3613945 | | 10/1986 | |
| EP | 0452671 | | 10/1991 | |
| EP | 0583584 | | 2/1994 | |
| EP | 0834647 | | 4/1998 | |
| JP | 2001336407 | A * | 12/2001 | F01L/13/00 |

OTHER PUBLICATIONS

Co–pending patent application: Ser. No., filed on Oct. 6, 1998, entitled Variable Valve Timing Mechanism, in the name of Yamaha Hatsudoki Kabushiki Kaisha.

* cited by examiner

*Primary Examiner*—Thomas Denion
*Assistant Examiner*—Ching Chang
(74) *Attorney, Agent, or Firm*—Knobbe, Martens, Olson & Bear, LLP.

(57) ABSTRACT

A valve actuating system for actuating at least one valve of an engine includes an improved mechanism for varying the timing and/or lift of the valve. The mechanism uses two adjacent rockers that cooperate with two adjacent cams of a camshaft. In one operating condition, movement of a first rocker is transmitted to the valve through the second rocker and in another operating condition only the movement of the second rocker is transmitted to the valve. The rockers preferably cooperate with cams having different lifts. The lift of the cam driving the first rocker preferably is greater than the lift of the cam driving the second rocker.

23 Claims, 8 Drawing Sheets

VALVE CONTROL FOR OUTBOARD MOTOR ENGINE

PRIORITY INFORMATION

This application is a continuation-in-part of U.S. patent application Ser. No. 09/470,845, filed Dec. 23, 1999 now abandoned, which claims priority from Japanese Patent Application No. 10-365,909, filed Dec. 24, 1998, and was laid-open on Jul. 4, 2000 as Japanese Laid-Open Application No. 2000-186516; the entire contents of these applications are hereby expressly incorporated by reference.

BACKGROUND OF THE INVENTION

1. Field of the Invention

This invention relates to an engine valve actuating system for an outboard motor and more particularly to an improved arrangement for achieving variable valve actuation (timing and/or lift) in the operation of an engine valve.

2. Description of Related Art

There is an increasing emphasis on obtaining more effective emission control, better fuel economy and, at the same time, continued increase in power output in outboard motors. Accordingly, four-cycle engines have started to replace two-cycle engines in outboard motors. It is difficult, however, to arrange all the components of a four-cycle engine into the limited space of an outboard motor cowling.

It is also desirable to achieve good emission control, fuel economy and high power output over the entire speed and load ranges of the outboard motor. In automotive four-cycle engines, there have been proposed a wide variety of devices to permit the engine characteristics to be adjusted when running so as to obtain optimum performance across the entire speed and load range. One such device is a variable valve actuating mechanism, which includes both changing valve timing and/or the valve lift. However, variable valve actuating mechanisms are typically complex and are not compact. Accordingly, because of the size constraints of an outboard motor, it previously has been difficult to employ variable valve actuating mechanisms in an outboard motor.

A need therefore exists for an engine with a variable valve actuating mechanism that is simply constructed and compact in structure.

SUMMARY OF THE INVENTION

One aspect of the present invention involves an engine comprising an output shaft and at least one cylinder having a cylinder axis. The output shaft and the cylinder are arranged such that a central plane, which contains the cylinder axis, either lies parallel to or contains an axis about which the output shaft rotates. A plurality of ports communicating with the cylinder and a plurality of valves selectively open and close the ports. At least a first valve is disposed on a first side of the central plane and at least a second valve is disposed on a second side of the central plane. A valve actuating mechanism comprises a camshaft having a plurality of cams and a pair of adjacent first and second rockers. A first support pivotally supports the first and second rockers. Each rocker has cam side arm with a following surface engaged with one of the cams to pivot the rocker about the first support. The first rocker has first and second bores and cam side arm with an operator that directly engages the first valve. The first bore slideably supports a first member and the second bore slideably supports a second member. The first support includes a first passage that communicates with the second bore. The second rocker further includes a first engagement surface that engages the first member. The second member is arranged to engage the first member when an actuating pressure is supplied to the first passage such that movement of the second rocker is transmitted to the first rocker. The valve actuating mechanism also includes at least a third rocker. The third rocker has cam side arm with a following surface, which engages another one of the cams to pivot the third rocker about a second support, and a valve side arm with an operator that directly engages the second valve.

Another aspect of the present invention involves an engine including a valve actuating mechanism comprising a camshaft with at least two adjacent intake cams and at least one exhaust cam. An intake rocker support supports a pair of adjacent, pivotally-supported first and second intake rockers. Each intake rocker has a cam side arm with intake following surface that is engaged with one of the intake cams for pivoting the intake rocker about the intake rocker support. The first intake rocker has a cam side arm with an operating portion that directly engages an intake valve of the engine. A first member is slideably supported within a first bore of the first intake rocker, a second member is slideably supported within a second bore of the first intake rocker. A first passage is located within the intake rocker support and communicates with the second bore. The second intake rocker further includes a first engagement surface that engages the first member. The second member selectively engages the first member when an actuating pressure is supplied to the first passage such that movement of the second intake rocker is transmitted to the first intake rocker. The valve actuating mechanism additionally comprises at least one exhaust rocker having a cam side arm with an exhaust following surface engaged with the exhaust cam for pivoting the exhaust rocker about an exhaust rocker support. The exhaust rocker support lies generally parallel to the intake rocker support and is on a side of the camshaft opposite the intake rocker support.

In accordance with an additional aspect of the present invention, a valve actuating mechanism is provided for an engine. A camshaft is located inside a cam cover and is driven by a crankshaft of the engine. The camshaft includes a plurality of cams. An intake rocker shaft extends along one side of the camshaft and an exhaust rocker shaft extends along generally an opposition side of the camshaft inside the cam cover. Intake and exhaust rockers are supported by the respective intake and exhaust rocker shafts for transmitting cam rotation to corresponding valves of the engine. Means is provided to selectively couple one of the valves to one of a pair of adjacent cams on the camshaft. The cams of the pair have the cams of the pair have different shapes to vary an operating characteristic of the corresponding valve. In one preferred mode, the cams have different lifts.

Additional aspects, features and advantages will be understood by the following description of several preferred embodiments of the present engine.

BRIEF DESCRIPTION OF THE DRAWINGS

The above-noted and other features, aspects and advantages of the present engine and valve actuating mechanism will now be described with reference to the drawings of preferred embodiments which are intended to illustrate and not to limit the invention. The drawings comprise 9 figures.

DETAILED DESCRIPTION OF THE PREFERRED EMBODIMENTS OF THE INVENTION

Embodiments of an improved internal combustion engine that includes a variable valve actuating mechanism will now be described in detail. The variable valve actuating mechanism enables the engine to produce high torque across large ranges of speeds and loads. As compared to prior art variable valve actuating mechanisms, the present mechanism uses fewer parts and less space. This reduction in size is particularly important for engines with space limitations, such as, for example, outboard motors. Accordingly, the present variable valve actuating mechanism is illustrated and described in the context of an outboard motor; however, certain aspects of the present invention can be used with engines of other types of vehicles, as well as with other types of prime movers.

Figure 1:
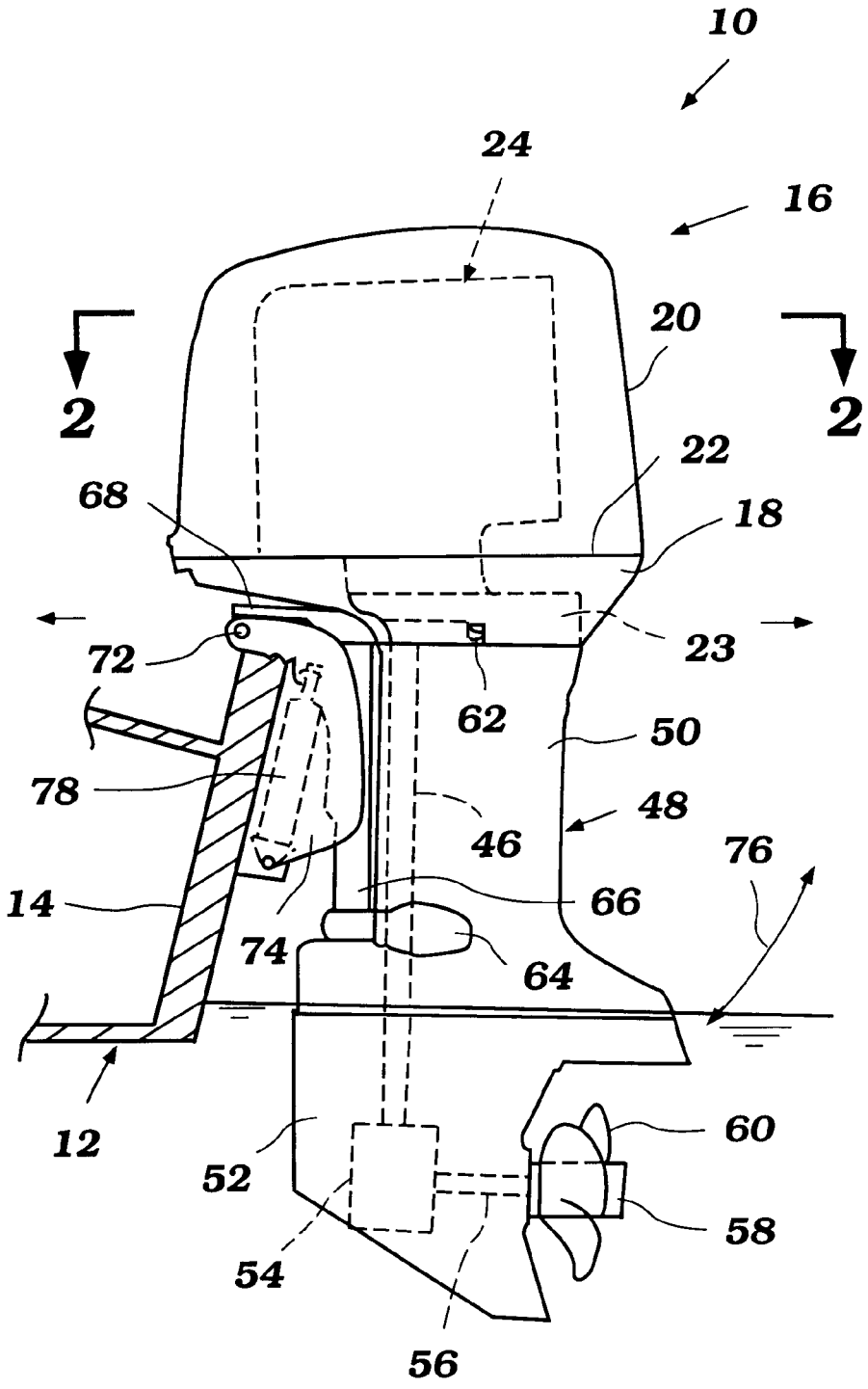
FIG. 1 is a side elevational view of an outboard motor which can embody an engine (shown in phantom) that is configured in accordance with a preferred embodiment of the present invention, the outboard motor being mounted to the transom of a watercraft (shown partially)

With reference to FIG. 1, an outboard motor is identified generally by reference numeral 10. The outboard motor 10 is shown as being attached to an associated watercraft hull, indicated generally by the reference numeral 12 and shown partially in cross-section. The outboard motor 10 is shown attached to a transom 14 of the hull 12 in a manner that will be described below.

The outboard motor 10 is comprised of a powerhead, indicated generally by the reference numeral 16. The powerhead 16 includes a bottom cowling portion 18 and an upper cowling portion 20 that is detachably connected to the bottom cowling portion 18 in a known manner. The upper cowling portion 20 is formed from a suitable material, such as a molded fiberglass reinforced resin or the like. The upper cowling portion 20 has a lower peripheral edge 22 that is held in a sealing engagement with the lower cowling portion 18 by a suitable latching device (not shown).

The lower cowling portion 18 preferably has an opening at its bottom portion through which an upper portion of an exhaust guide member or support member 23 extends. The exhaust guide member 23 preferably is made of an aluminum-based alloy. The bottom cowling member 18 and the exhaust guide member 23 together generally form a tray. An engine 24, which is indicated generally by the reference numeral 24 and which has a construction that will be described later in more detail, is placed onto this tray and is affixed to the exhaust guide member 23. The exhaust guide member in this manner supports the engine 24. The exhaust guide member 23 also has an exhaust discharge passage through which burnt charges (e.g., exhaust gases) from the engine 24 are routed as described below.

The protective cowling 20 encircles the internal combustion engine 24. In the illustrated embodiment, the engine 24 is a V6, four-stroke engine. However, those skilled in the art will readily appreciate that several aspects of the variable valve actuating mechanism can be used with a variety of engines with different cylinder configurations (e.g., in-line or slanted) and/or with more or less cylinders (e.g., four cylinders).

Figure 2:
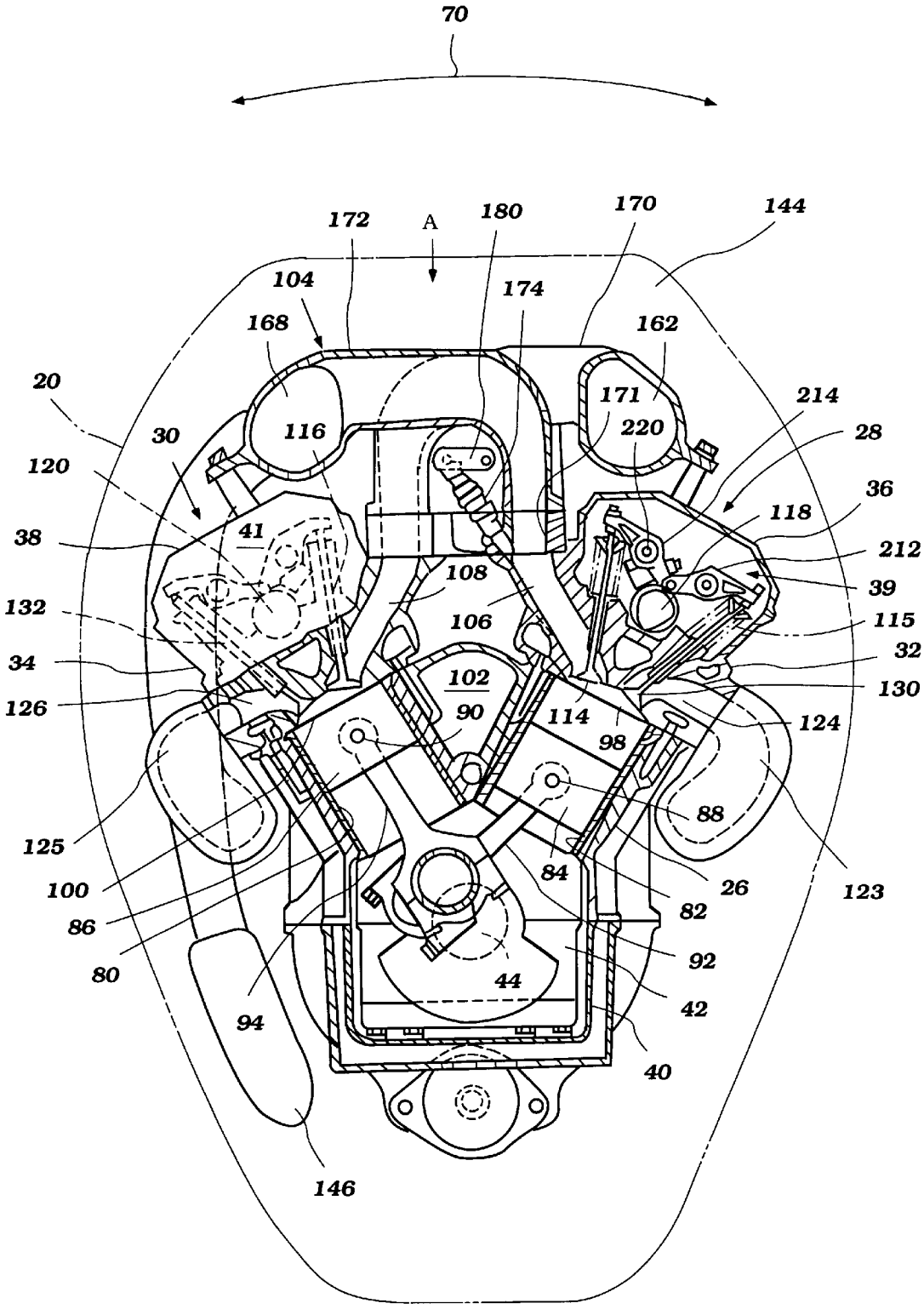
FIG. 2 is a top plan and partial cross-sectional view along line 2—2 in FIG. 1, with an upper cowling of the outboard motor shown substantially in phantom.

As shown in FIG. 2, the engine 24 includes cylinder block 26 which includes a pair of cylinder banks 28, 30 arranged in a V-type configuration. The cylinder banks 28, 30 are closed at their rear ends (i.e., the end farthest from the transom 14 of the boat) by cylinder head assemblies 32, 34 in a manner which will be described. Cam covers 36, 38 are affixed to the cylinder head assemblies 32, 34, respectively, and enclose respective cam chambers 39, 41 in which the valve actuating mechanisms contained. In the illustrated embodiment, these valve actuating mechanisms include a single overhead camshaft for each cylinder head assembly 32, 34, as described in greater detail below.

A crankcase member 40 is affixed to the end of the cylinder block 26 opposite the cylinder heads 36, 38. As such, the crankcase member 40 defines a crankcase 42 having an upper surface 43 (FIG. 3), and in which a crankshaft 44 is rotatably journaled. As is typical with outboard motor practice, the engine 24 is mounted in the powerhead 16 so that the crankshaft 44 rotates about a generally vertically extending axis. This facilitates coupling to a driveshaft 46 (FIG. 1).

As shown in FIG. 1, the driveshaft 46 extends into and is journaled within a driveshaft housing, indicated generally by the reference numeral 48, and which is enclosed in its upper end by the tray (i.e., by the exhaust guide 23 and bottom cowling member 18). This driveshaft housing 48 includes an outer housing casing 50. The exhaust guide 23 thus is interposed between the engine 24 and the upper end of the driveshaft housing 48 within the lower cowling member 18.

The driveshaft 46 extends into a lower unit 52, wherein it drives a conventional bevel gear, forward, neutral and reverse transmission, indicated generally by the reference numeral 54 and shown only schematically. The transmission 54 is shown in a schematic fashion, and any known type of transmission may be employed.

The transmission 54 drives a propeller shaft 56 which is journaled within the lower unit 52 in a known manner. A hub 58 of a propeller 60 is coupled to the propeller shaft 56 for providing a propulsive force to the watercraft hull 12.

A steering shaft (not shown) is attached to the outer housing casing 50 by an upper bracket assembly 62 and a lower bracket assembly 64. The steering shaft is supported for steering movement within a swivel bracket 66 so as to pivot about a vertical steering axis. The steering axis is juxtaposed to and disposed slightly forward of the driveshaft 46. A tiller or steering arm 68 is affixed to the upper end of the steering shaft for steering the outboard motor 10 through an arc 70 (FIG. 2). The swivel bracket 66 is connected by a pivot pin 72 to a conventional clamping bracket, indicated generally by the reference numeral 74 and partially depicted. The pivot pin 72 permits tilt and trim movement of the swivel bracket 66 and outboard motor 10 relative to the transom 14 of the hull 12. This tilt and trim movement is indicated by the arc 76 (FIG. 1).

A hydraulic tilt and trim mechanism 78 can be pivotally connected between the swivel bracket 66 and the clamping bracket 74 for effecting the tilt and trim movement, and for permitting the outboard motor 10 to pop up when an underwater obstacle is struck. As is well known, these types of hydraulic mechanisms 78 permit the outboard motor 10 to return to its previous trim adjusted position once such an underwater obstacle is cleared.

With reference to FIG. 2, the construction of the engine 24 will now be described in more detail. As has been noted, the illustrated engine 24 is of the V-type and, accordingly, the cylinder block 26 is formed with a pair of angularly related cylinder banks 28, 30, each of which is formed with a plurality of horizontally-extending cylinder bores 80, 82. The cylinder bores 80, 82 may be formed from thin liners that are either cast or otherwise secured in place within the cylinder banks 28, 30. Alternatively, the cylinder bores 80, 82 may be formed directly in the base material of the cylinder banks 28, 30. If a light alloy casting is employed for the cylinder banks 28, 30, such liners can be used.

Figure 3:
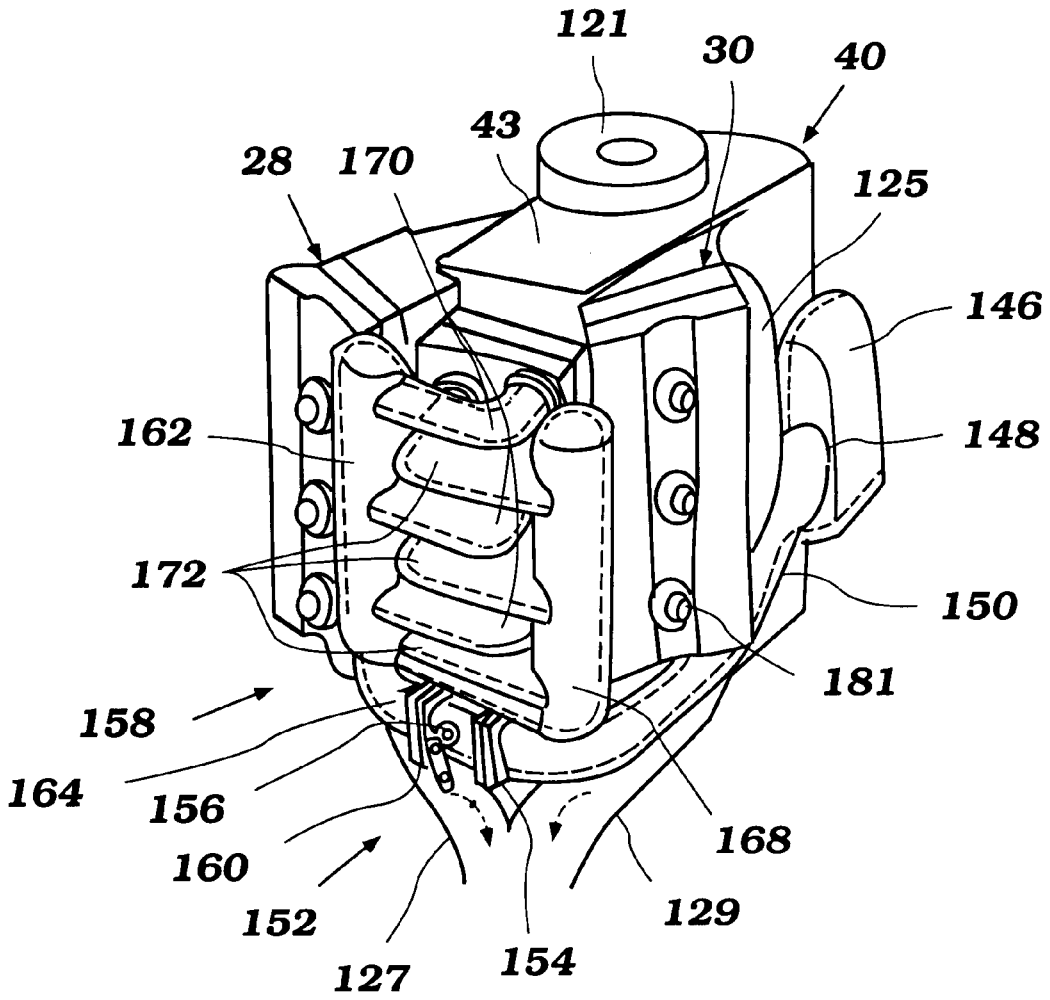
FIG. 3 is a rear, top, and right (i.e., starboard) side perspective view of the engine shown in FIGS. 1 and 2.

In the illustrated embodiment, the cylinder banks 28, 30 each include three cylinder bores 80, 82. Since the engine 24 is a V-type engine, the cylinder bores 80, 82 in each cylinder bank preferably are staggered with respect to one another. Thus, as shown in FIG. 3, the uppermost cylinder bore in the left cylinder bank 30 (left as shown in FIG. 2) is at an elevation higher than the uppermost cylinder bore in the right cylinder bank 28 (right as shown in FIG. 2).

With reference to FIG. 2, pistons 84, 86 are supported for reciprocation in the cylinder bores 80, 82, respectively. Piston pins 88, 90 connect the pistons 84, 86 to respective connecting rods 92, 94. The connecting rods 92, 94, as is typical in V-type practice, may be journaled in side-by-side relationship on adjacent throws of the crankshaft 44. That is, pairs of cylinders, 80, 82, one from each cylinder bank 28, 30, may have the big ends of their connecting rods 92, 94 journaled in side-by-side relationship on adjacent crankshaft throws. This is one reason why the cylinder bores 80, 82 of the cylinder banks 28, 30 are staggered relative to each other. In the illustrated embodiment, however, separate throws are provided for the cylinders of each cylinder bank 28, 30. The throw pairs are nevertheless disposed between main bearings (not shown) of the crankshaft 44 to maintain a compact construction.

The cylinder head assemblies 32, 34 are provided with individual recesses 98, 100 which cooperate with the respective cylinder bores 80, 82 and heads of the pistons 84, 86 to form the combustion chambers. These recesses 98, 100 are surrounded by a lower cylinder head surface that is planar and held in sealing engagement with either the cylinder banks 28, 30 or with the cylinder head gaskets (not shown) interposed therebetween, in a known manner. These planar surfaces of the cylinder head assemblies 32, 34 may partially override the cylinder bores, 80, 82 to provide a squish area, if desired. The cylinder head assemblies 32, 34 are affixed in any suitable manner to the cylinder banks 28, 30.

Because of the angular inclination between the cylinder banks 28, 30, as is typical with V-type engine practice, a valley 102 is formed between the cylinder head assemblies 32 and 34. An induction system for the engine, indicated generally by the reference numeral 104, is positioned in part in the valley 102. The induction system 104 includes intake passages 106, 108 that extend from a surface of the respective cylinder head assemblies 32, 34 to valve seats formed on the combustion chamber recesses 98, 100. A single intake passage and port may be formed for each combustion chamber recess 98, 100 or, alternatively, there may be multiple valve seats for each recesses 98, 100.

Poppet-type intake valves 114, 116 are slideably supported in the cylinder head assemblies 32, 34 in a known manner, and have their head portions engageable with the valve seats so as to control the flow of the intake charge into the combustion chambers through the intake passages 106, 108. The intake valves 114, 116 are biased toward their closed position by coil compression springs 115 (see FIG. 4). The intake valves 114, 116 are operated by single overhead camshafts 118, 120, respectively, which are journaled in the cylinder head assemblies 32, 34. The rotational axes of the camshafts 118, 120 are generally parallel to the axis of the crankshaft 44 (i.e., generally vertical). The manner in which the intake valves 114, 116 are opened and closed by the camshafts 118, 120 will be described later.

The intake camshafts 118, 120 are driven by the crankshaft 44 via a camshaft drive mechanism, which is not shown. Such camshaft drive mechanisms are well known in the art and they can be considered to be conventional. Thus, a further description of the camshaft drive mechanism is not believed necessary for one of ordinary skill in the art to use the present valve actuating mechanism.

A flywheel-magneto assembly 121 is disposed at the upper end of and connected to the crankshaft, as best understood from FIG. 3. A flywheel cover desirably covers the flywheel-magneto assembly 121.

On the outer side of the respective cylinder bank 26, 28, each cylinder head assembly 32, 34 is connected with one or more exhaust passages 124, 126 (FIG. 2). Each exhaust passage 124, 126 emanate from one or more valve seats formed in the cylinder head recesses 98, 100, and cooperates with exhaust systems for discharging exhaust gasses to the atmosphere through a path that will be described later.

As shown in FIG. 2, exhaust valves 130, 132 are supported for reciprocation in the cylinder head assemblies 32, 34, respectively, in a manner similar to the intake valves 114, 116. The exhaust valves 130, 132 are biased toward their closed positions by coil compression springs 115 (see FIG. 4). The exhaust valves 130, 132 like the intake valves 114, 116 are opened and closed by the single overhead camshafts 118, 120. The manner in which the exhaust 130, 132 valves are opened and closed by the camshafts 118, 120 will be described later.

Figure 4:
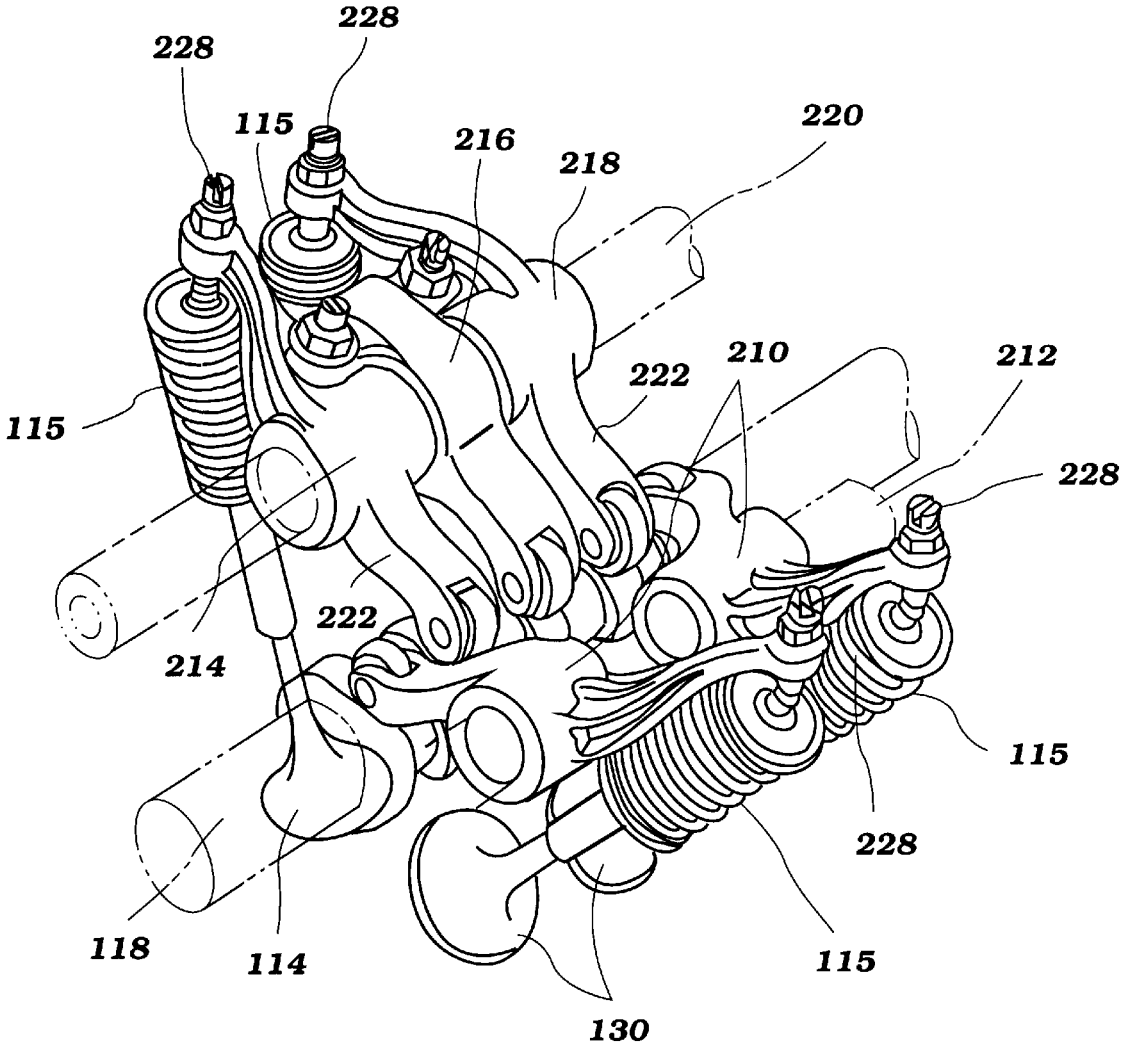
FIG. 4 is a rear, top, and left (i.e., port) side perspective view of a valve actuating mechanism having certain features and advantages according to a preferred embodiment of the present invention.

With reference to FIGS. 1 and 2, the engine 24 discharges exhaust gases through the exhaust manifolds 123, 125, and down into a silencing arrangement provided with an internal expansion chamber in the driveshaft housing 48 through exhaust pipes 127, 129 (see FIG. 4). The exhaust pipes 127, 129 extend from the exhaust manifolds 123, 125, respectively. The exhaust pipes 127, 129 extend into an expansion chamber formed at the rear of the driveshaft housing (not shown). The expansion chamber terminates at its lower end in an exhaust gas discharge formed in the lower unit 52 for delivering the exhaust gases to the atmosphere, through the body of water in which the associated watercraft is operating. Although the preferred embodiment illustrates an exhaust passage through the hub, any type of conventional above-the-water exhaust gas discharge can be used with the outboard motor. For example, the exhaust discharge may include an underwater, high speed exhaust gas discharge and an above the water, low speed exhaust gas discharge.

The induction system 104 for the engine 24 is discussed with reference to FIGS. 2–4. As is typical with outboard motor practice, the powerhead 16, and specifically the main cowling portion 20, is formed with at least one air inlet opening (not shown). The air inlet opening desirably is configured so as to permit copious amounts of air to flow into the interior of the protective cowling while at the same time inhibiting water entry. Any of the known inlet type devices can be utilized for this purpose.

In conjunction with the induction system 104 for the engine 24, it is desirable to provide a relatively large plenum area that supplies the individual cylinders through respective runners. The use of a plenum area is desired so as to minimize the interference from one cylinder to the others. This presents a particular space problem, particularly in conjunction with outboard motors where space is at a premium. Therefore, the induction system 104 is designed so as to provide a large plenum volume and still maintain a compact construction. Furthermore, construction is such that servicing of the engine is not significantly affected.

As shown in FIGS. 2 and 3, the cowling member 20 forms an engine compartment 144 around the engine 24. The induction system includes an air inlet device 146, positioned adjacent the crankcase chamber 42 of the engine 24. The inlet device 146 includes at least one orifice (not shown) configured to allow air from the engine compartment 144 to enter the inlet device 146. The inlet device 146 also includes an outlet 148 connected to an induction passage 150.

The induction passage 150 extends between the inlet device and a throttle device 152. The induction passage 150 is connected to the throttle device by a flange assembly 154. The flange assembly 154 is formed of a plurality of plates and fasteners that are configured to form a substantially air tight fluidic connection between the air induction passage 150 and the throttle device 152.

The throttle device 152 in the illustrated embodiment includes a throttle body 156 and a throttle valve (not shown) journaled within the throttle body 156. Of course, other types of throttle devices also can be used. The throttle valve is operated by a remote actuator. By utilizing a single throttle device 152 for the induction system, the overall construction of the induction system 104 can be significantly simplified.

As shown in FIG. 3, the throttle device 152 is positioned below the intake runners 170, 172 and above the exhaust pipes 127, 129. In the illustrated embodiment, the throttle body 156 is disposed above the point at which the exhaust pipes 127, 129 merge together. The throttle body 156 is attached to a branch portion 158 of the induction passage 150 via a flange assembly 160 which may be constructed identically to flange assembly 154. The branch portion 158 includes a junction portion 164 downstream from the flange 160.

The junction portion 164 divides the induction passage 150 into a first branch passage and a second branch passage. The first branch passage extends from the junction portion 164 to the second plenum chamber 168. The second branch passage extends forwardly from the junction portion 164 and along a forward side of the throttle device, then curves upwardly to the first plenum chamber 162. As such, the junction portion 164 divides the air flow emanating from the throttle device 152 so as to feed the plenum chambers 162, 168 with substantially equal flows of air.

With reference to FIG. 2, the plenum chambers 162, 168 overlie at least a portion of the cam covers 36, 38 and are mounted thereon by mounting posts (not shown) which have threaded fasteners, so as to provide a rigid assembly. As shown in FIG. 3, the plenum chambers 162, 168 extend substantially the full length of the respective cylinder banks 28, 30, and thus provide a substantial volume for the inducted air.

With reference to FIG. 3, each plenum chamber 62, 68 communicates with a plurality of runners 170, 172, respectively. The runners 170, 172 extend transversely across the upper portion of the engine valley area 102 and curve downwardly so as to communicate with the respective intake passages 106, 108 formed in the head assemblies 32, 34. A connection plate 171 connects the runner 170, 172 to the intake passages 106, 108. The runners 170, 172 are in direct alignment with the passages 106, 108 formed in the head assemblies 32 and 34. The runners 170, 172 thus communicate with respective intake passages 106, 108 formed in the cylinder head assembly 32, 34 that are disposed on an opposite side of the valley from the respective plenum chambers 62, 68.

Thus, this arrangement provides not only a large effective plenum chamber volume, since each plenum chamber 162, 168 serves only three cylinders, but also provides relatively long runners 170, 172 that extend from the plenum chambers 162, 168, to the cylinder head induction passages 106, 108. The length of these runners 170, 172 can be tuned relative to the volume so as to provide the desired charging effect in the induction system 104. The described arrangement with the long runners 170, 172 is particularly effective at midrange speeds.

As seen in FIG. 2, the illustrated engine 24 is provided with a manifold type fuel injection system. The fuel injection system includes the plurality of fuel injectors 174, one fuel injector 174 for each cylinder head induction passage 106, 108. The fuel injectors 174 are disposed in the area between the reentrant positions of the runners 170, 172 and hence, are protected by these runners, since they are partially surrounded by them, while at the same time being accessible. Thus, air may flow over the injectors 174 so as to cool the injectors 174 along with the air flowing through the runners 106, 108. Preferably, the injectors 174 are of the electrically operated type embodying solenoid actuated valves.

The injectors 174 for the respective cylinder banks 28, 30 are mounted in a manifold flange which is contiguous with the flow passages 106, 108. Hence, the fuel spray from the injectors 174 can easily mix with the air flowing into the combustion chambers 98, 100 so as to provide a good mixture distribution. Other types of charge formers, however, can be used with the present engine. Such charge formers include, without limitation, direct injection fuel injectors and carburetors.

The injectors 174 have their tip inlet portions received in a fuel rail 180 that extends vertically through the area encompassed by the runners 170, 172 and is thus protected by the runners 170, 172. The fuel rail 180 has two flow passages, one for the fuel injectors 174 of the cylinder bank 28, and one for the fuel injectors 174 of the cylinder bank 30. As such, the flow passages within the fuel rail 180 are in side-by-side relationship and accommodate the crossover relationship of the injectors 174.

A suitable fuel supply system is provided for supplying fuel to the fuel rail 180. Such fuel systems are well known in the art and they can be considered to be conventional. Thus, a further description of the fuel delivery system is not necessary for one of ordinary skill in the art to understand the present engine.

With reference to FIG. 3, sparkplugs 181 are mounted in the cylinder head assemblies 32, 34. Although not illustrated in the figures, the spark plugs 181 are mounted with their electrodes (i.e., gaps) extending into the recesses 98, 100 (FIG. 2). The sparkplugs 181 are fired by suitable ignition system.

As shown in FIG. 3, the overall height of the engine 24 is reduced by positioning the throttle device 152 below the runners 170, 172. In addition, with the throttle device 152 mounted at a position between the induction runners 170, 172 and the exhaust pipe, the present engine design effectively utilizes a large dead space which has gone unused in known outboard motors with V-type engines.

As discussed above, one advantage stemming from positioning the throttle device 152 at least partially below the upper surface of the crankcase 42, and the thus resulting reduction in the overall height of the engine, is that a tight fitting cowling may be fit over the engine which is shorter in overall height than a known conventional cowling. As discussed above, since the upper portion or the powerhead of an outboard motor is subjected to significant airflow during certain operation conditions, it is desirable to shape the upper cowling so as to minimize the frontal area of the cowling. By reducing the frontal area of the cowling the aerodynamic drag on the watercraft using the outboard motor 10 is therefore reduced.

The variable valve actuating mechanism will now be described with reference to FIGS. 2, 4, 5, and 6. As best seen in FIGS. 2 and 4, the intake valves 114, 116 and the exhaust valves 130, 132 are controlled by single overhead cam shafts 118, 120. As mentioned above, the camshafts 118, 120 in the illustrated embodiment are suitably journaled within the cylinder head assemblies 32, 24 for rotation about a generally vertical camshaft axis that is generally parallel to the crankshaft axis.

Figure 5:
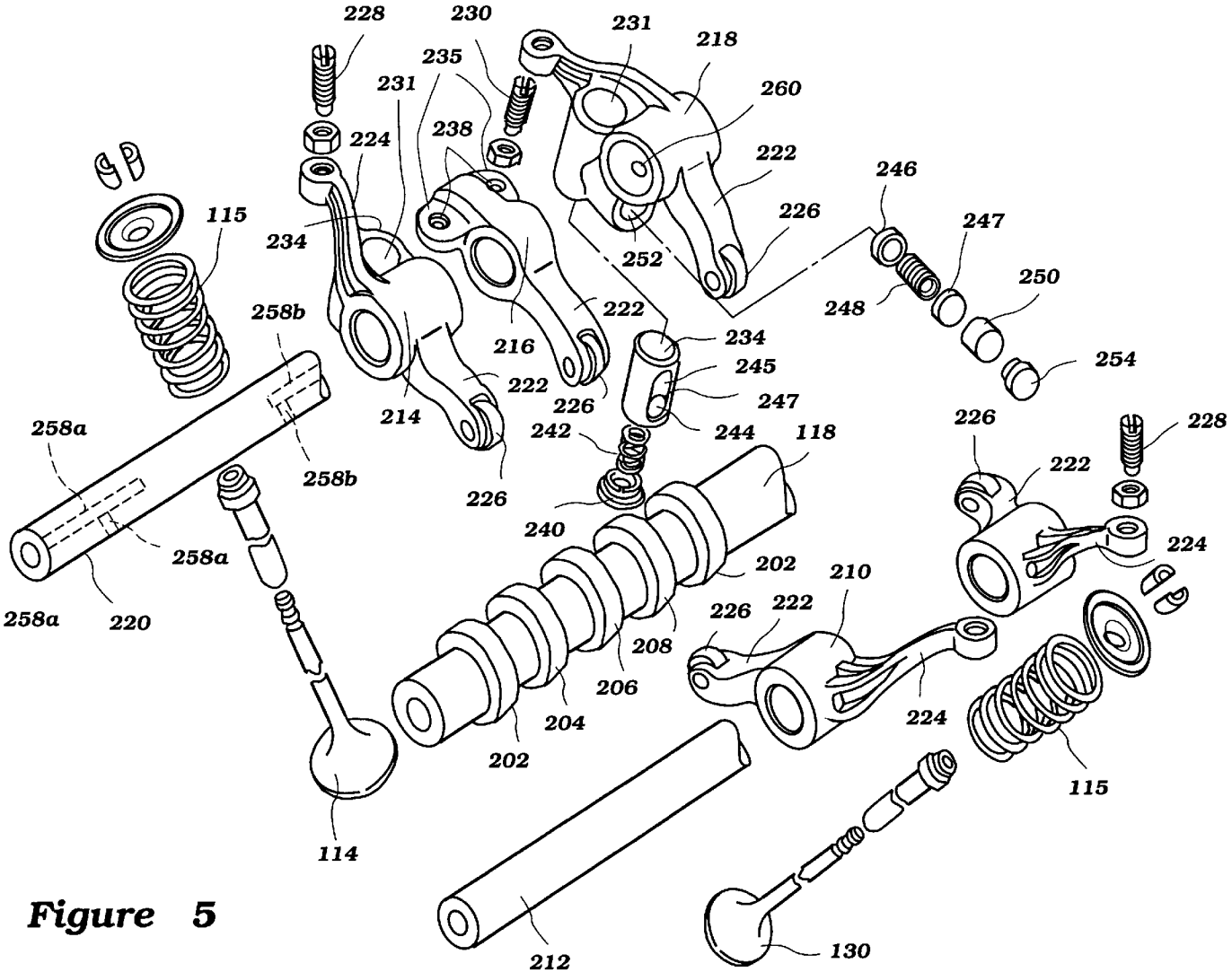
FIG. 5 is an exploded view of the valve actuating mechanism of FIG. 4.

As best seen in FIG. 5, each camshaft 118, 120 preferably has five cam lobes per cylinder. The construction of the valve actuating mechanism for each cylinder preferably is substantially the same. Accordingly, the following description focuses on one of the valve actuating mechanisms associated with the port-side camshaft 118. Unless indicated otherwise, the valve actuating mechanisms for the other cylinders have the same construction.

In the illustrated embodiment, the two outer cam lobes are the exhaust cams 202. Associated with exhaust cams 202 are the exhaust valve rocker 210, which are journaled on a common exhaust rocker shaft 212. The exhaust rocker shaft 212 is suitably supported within the cylinder head assemblies 32, 34. The axis of the exhaust rocker shaft 212 lies generally parallel to the camshaft 118 axis and preferably is offset to one side of the camshaft 118 towards the exhaust valves 130, 132.

The exhaust rockers 210 include cam side arms 222 that extend from the rocker shaft 212 towards the camshaft 118. At the tip of each cam side arm 222 is a follower surface or roller 226 that cooperates with the exhaust cam lobes 202 for pivoting the corresponding exhaust rocker 210 about the rocker shaft 212. The exhaust rockers 210 also include valve side arms 224 that extend from the rocker shaft 212 towards the exhaust valves 130, 132. Adjusting screws 228 carried by valve side arms 224 contact the tips of the exhaust valves 130, 132 for actuating the exhaust valves in a known manner. As mentioned above, the exhaust valves 130, 132 are biased in a closed position by coil compression springs 115. The coil compression springs 115 also bias the cam side arms 222 towards the cam shaft 118 so that the rocker follower surface 226 maintains engagement with the exhaust cam lobes 202.

The middle three cam lobes comprise the low lift intake cam 204, the high lift intake cam 206, and the medium lift intake cam 208. Associated with the intake cams 204, 206, 208 are the low, high, and middle intake rockers, indicated generally by the reference numerals, 214, 216, 218. These intake rockers 214, 216, 218 are journaled on a common intake rocker shaft 220 that is suitably supported within the cylinder head assemblies 32, 34. The axis of the intake rocker shaft 220 lies generally parallel to the axes of the camshaft 118 and the exhaust rocker shaft 212. Preferably, the intake rocker shaft 220 lies on a side of the camshaft 118 opposite the exhaust rocker shaft 212 and towards the intake valves 114, 116.

As may be best seen from FIGS. 4 and 5, the low and medium cams lobes 204, 208 and their cooperating intake rockers 214, 218 are each associated with one of the intake valves 114. The high cam lobe 206 and its cooperating intake rocker 216 are not directly associated with an intake valve. However, as will be described below, the high cam rocker 216 can be selectively coupled to either the low or medium rockers 214, 218.

The low and medium intake rockers 214, 218, like the exhaust rockers, have cam side arms 222. At the end of each cam side arm 222 are followers or rollers 226, which are engaged with the low and medium cam lobes 204, 208 for pivoting the low and medium intake rockers 214, 218 about the intake rocker shaft 220. The low and medium intake rockers 214, 218 also include valve side arms 224 that extend from the intake rocker shaft 220 towards the intake valves 114. Adjusting screws 228 carried by the valve side arms 224 contact the tips of the intake valves 114 for actuating the intake valves in a known manner. As with the exhaust valves, the intake valves 114 are biased in a closed position by coil compression springs 115. The coil compression springs 115 also bias the cam side arms 222 towards the cam shaft 118 so that rocker follower surface 226 maintains engagement with the low and medium cam lobes 204, 208. Thus, the low and medium intake rockers 214, 218 generally operate as conventional rockers for the valve actuation during such time as the high rocker 216 is not coupled to either of the rockers 214, 218. This coupling method will be described later.

At this point, it should be noted that the low, high and medium cam lobes 204, 206, 208 are preferably of different lifts and diameters. The cam lobes 204, 206 can also be configured to provide slightly different timing. Preferably, the high cam lobe 206 preferably has a higher lift and larger diameter than that of the low and medium cam lobe 204, 206. More preferably, the medium cam lobe 206 has a higher lift than the low cam lobe 204. That is, in one preferred arrangement, the low cam lobe 204 has a lift L1, high cam lobe have a lift L2 and the medium can has a lift L3 and $L1<L2<L3$.

Figure 6A:
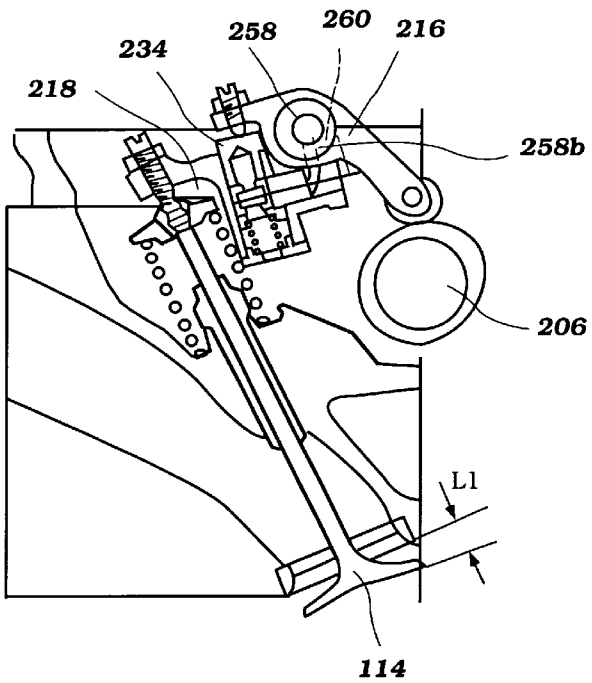
FIG. 6A is a schematic cross-sectional view of the valve actuating mechanism of FIG. 4 in an unlocked position.
Figure 6B:
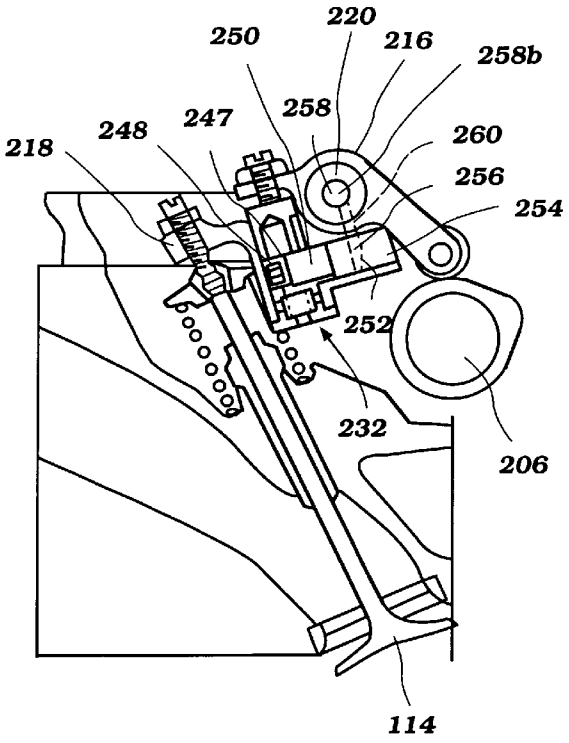
FIG. 6B is a schematic cross-sectional view of the valve actuating mechanism of FIG. 4 in a locked position.

The mechanism for selectively coupling the high intake rocker 216 to operate the low and medium intake rockers 214, 218 will now be described with particular reference to FIGS. 5, 6A and 6B. FIG. 6A show the coupling mechanism, which is indicated generally by the reference numeral 232, in the disengaged condition so that the low intake rocker 214 and medium intake rocker 216 operate without any control or interference from the high intake rocker 216. Under this condition, the low and medium cam lobes 204, 208 and low and medium intake rockers 214, 218 control the degree of maximum opening (L1) and timing of opening of the intake valves 114 with the fully-opened position being shown in FIG. 6A.

As best seen in FIG. 5, the low and medium intake rockers 214, 218 have boss portions 230 that extend from the valve side arm 224 towards the high intake rocker 216. Cylindrical bores 231 are formed in the boss portions 230. A coupling plunger member 234 is slideably supported within each bore 231. The head or top portion of each coupling plunger member 234 is engaged by an adjusting screw 236. The adjusting screws 236 extend through threaded holes 238 formed in wing shaped protrusions 235 that extend from the cam side arm 222 of the high intake rocker 216 towards the low and medium intake rockers 214, 218.

As may be best seen in FIGS. 5 and 6A, the lower end of each boss portion 230 is at least partially closed by a cap 240 which braces a biasing spring 242 that acts on the lower end of each coupling plunger member 234. This spring 242 keeps the coupling plunger member 234 and specifically its top surface in constant engagement with the adjusting screw 236. It should be apparent, however, that if desired, some clearance can be maintained between each adjustment screw 236 and the top surface of corresponding coupling plunger member 234.

Each coupling plunger member 234 is formed with a bore 244 that extends from a flat surface 245 formed on a side thereof by a machined recess. Received within the bore 244 is a return spring arrangement that is comprised of a pair of end caps 246, 247 that are urged apart by a coil compression spring 248.

In the uncoupled state when only the low and medium cams 204, 208 are operating the valves 114, this compression spring 248 causes one end cap 247 to be urged to a position where it sits flush with the flat surface 245 of the coupling plunger member 234. Under this condition the end cap 247 generally abuts a slideable locking member 250.

Each locking member 250 is slideably supported within a bore 252 that extends through another boss of the low and medium intake rockers 214, 218. The boss is formed just below the respective journal of the low and medium intake rockers 214, 218 on the intake rocker shaft 220. The outer end of each bore 252 is closed by a closure plug 254 and in the uncoupled state, the locking member 250 generally floats between closure plug 254.

Figure 7:
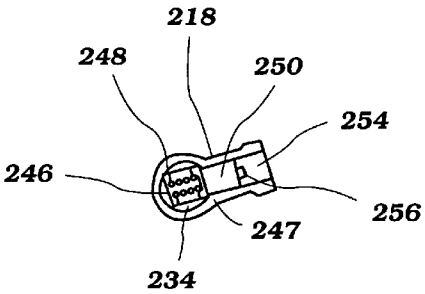
FIG. 7 is a cross-sectional view of a locking mechanism of the valve actuating mechanism take on long line 7—7 of FIG. 6A.

The cooperation of the locking member 250 with the flat surface 245 of the coupling plunger member 234 permits reciprocation of the coupling plunger member 234 in the bore 231 (see also FIG. 7). Accordingly, when the high cam lobe 206 causes the high intake rocker 216 to begin its lift, the coupling plunger members 234 will be driven downwardly in the bores 231. Under this condition, the low and medium intake rockers 214, 218 will experience no additional movement, and thus there is lost motion under this operation. In other words, movement of the high intake rocker 216 is not transmitted to the intake valves 114.

It should be noted that in the retracted position of the locking members 250 in the uncoupled state, gap 256 are provided between each locking member 250 and the respective closure plug 254. Each gap 256 communicates with an oil control passage 258*a*, 258*b* that extends through the rocker shaft 220 to the low and medium intake rockers 214, 218 respectively. Second passages 260 extend through the low and medium intake rockers 214, 218 to connect each oil control passage 258*a*, 258*b* to the respective gap 256. The rocker shaft 220 contains a plurality of lumens or passages 258 of which the first and second passages 258*a*, 258*b* form a part; however, in one variation the rocker shaft 220 is hollow and a single central passage communicates with both the first and second passages 258*a*, 258*b* that branch off the central passage 258.

Hydraulic fluid pressure may be exerted selectively through one or both of the passages 258*a*, 258*b* to the respective gap 256 in accordance with a desired control strategy. One such strategy will be described later with reference to FIG. 7. Another control strategy, which can be used with a mechanism employing only one control passage 258, is to have the valves actuated by (1) the low and medium cams 204, 208; and/or (2) just the high cam 206. The hydraulic fluid pressure applied to each gap 256 is sufficient to overcome the spring force applied by the respective spring 248 within the bore 244 of the coupling plunger 234 so as to actuate the locking member 250. When actuated, the locking member 250 is disposed partially in the bore 244 of the coupling member 234 and partially in the second bore 252 of the intake rocker 214, 218. The coupling plunger 234 thus cannot move relative to the body of the intake rocker 214, 218.

When both control passages 258*a*, 258*b* are pressurized, each locking plunger 250 registers with the engagement bore 244 and acts on the retainer member 246 to force it to inwardly compress the spring 248. At this time, the high intake rocker 216 will be coupled to the low and medium rockers 214, 218. Because of its greater lift and timing, it will actually control the opening of the valves 114 so as to provide a greater lift under this coupled condition as clearly shown in FIG. 6B. As explained below, the control passages 258*a*, 258*b* can be separately pressurized to provide a number of control modes for the valve actuating mechanism.

When the hydraulic pressure in the passages 258*a*, 258*b* and gap 256 is relieved, the spring 248 will urge the locking member 250 back to its disengaged position as shown in FIG. 6A.

Accordingly, this simple and relatively small variable valve actuating mechanism provides at least four modes of valve actuation. In a first mode, the control passages 258*a*, 258*b* are not pressurized. Therefore, as illustrated in FIG. 6A and described above, the locking members 250 in both the low and medium rockers 214, 218 are not engaged with the engagement bore 244. Movement of the coupling plunger member 234 that is caused by the movement of the high rocker 216 is absorbed by the spring 242 and is not transmitted to the low and medium rockers 214, 218. Accordingly, the lift amount (L1) and timing of the intake valves 114 are controlled by the low and medium cam lobes 204, 208. It should be noted that varying types of lift arrangements may be employed and different lift ratios and/or valve timing between the two valves. That is the lift and/or timing of the valve operated by the low cam lobe 204 may be the same or different than the medium cam 208.

In a second mode, pressure is only applied to the control passage 258*b* that communicates with the medium intake rocker 218. Accordingly, as illustrated in FIG. 6B, the locking member 250 is engaged with the engagement bore 244 of the medium intake rocker 218. As a result, the coupling plunger 234 cannot freely move within the bore 231 and movement of the high intake rocker arm 216 is transmitted to the medium intake rocker arm 218. Therefore, the lift and timing of the intake valves 114 are respectively controlled by the low cam 204 and the high cam 206.

In a third mode, pressure is only applied to the control passage 258*a* that communicates with the low intake rocker 214. Accordingly, the locking member 250 is engaged with the engagement bore 244 of the low intake rocker 214. As a result, the coupling plunger 234 cannot freely move within the bore 231 and movement of the high intake rocker arm 216 is transmitted to the low intake rocker arm 214. Therefore, the lift and timing of the intake valves 114 are respectively controlled by the high cam 206 and the medium cam 204.

In a fourth mode, pressure is applied to both control passages 258*a*, 258*b*. Accordingly, the locking members 250 in both the low and medium intake rockers 214, 218 are engaged with the engagement bores 244. As a result, the coupling plungers 234 cannot freely move within the bores 231 and movement of the high intake rocker arm 216 is transmitted to the low and medium intake rocker arms 214, 218. Therefore, the lift and timing of the intake valves 114 are respectively controlled by the high cam 206.

Figure 8:
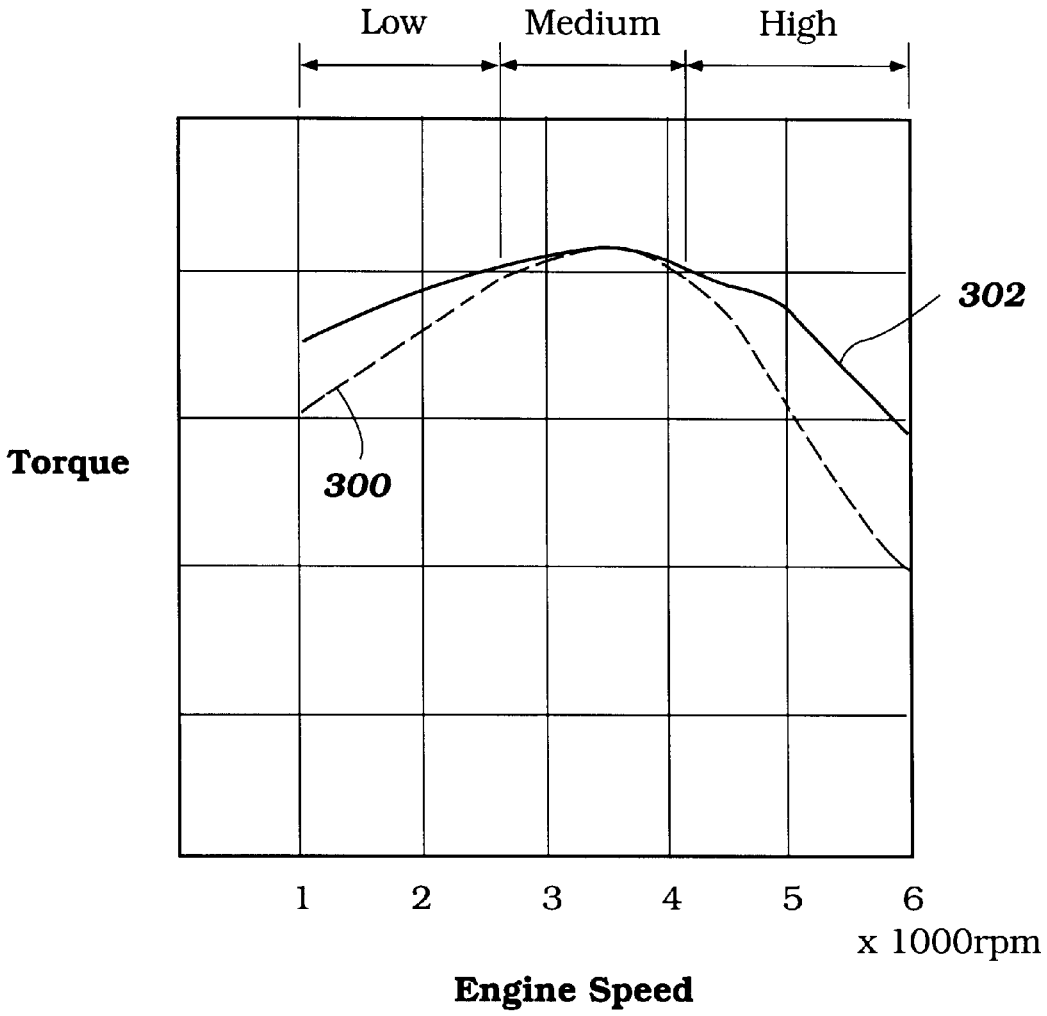
FIG. 8 is a graph showing the potential effects of the valve actuating mechanism on engine torque.

FIG. 8 illustrates the effects on engine performance that can be achieved using the present valve actuating mechanism. The dashed line 300 represents the typical torque performance of an engine without a variable valve timing. As is typical, torque decreases sharply at high and low engine speeds because of the inherent design compromises that are made when choosing valve lift and timing.

The solid line 302 represents the improved torque performance that can be achieved when using the present valve actuating mechanism. To achieve the improved performance, the valve actuating mechanism can be operated in the first mode during low speed operation. In this mode, the lift and timing of the intake valves 114, 116 are controlled by the low and medium cams 204, 208. During medium speed operation, the valve actuating mechanism can be operated in the second or third mode. That is, the lift and timing of the intake valves 114, 116 are controlled by the low and high cams 204, 206 or the medium and high cams 208, 206. During high speed operation, the valve actuating mechanism can be operated in the fourth mode wherein the lift and timing of the intake valves 114, 116 are controlled by the high intake cam 206. Accordingly, as is evident from FIG. 8, a relatively flat torque curve can be achieved.

Figure 9:
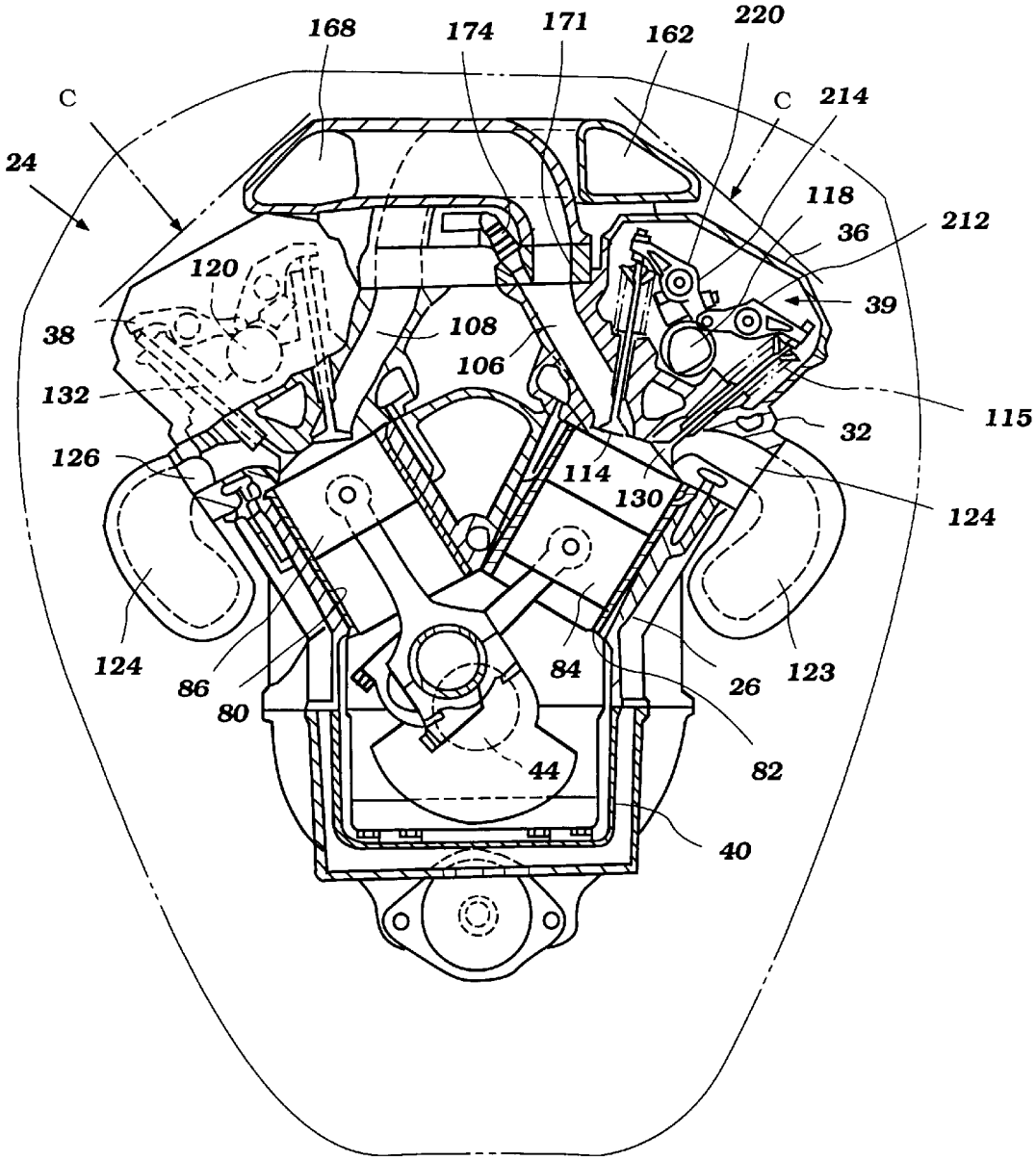
FIG. 9 is a top plan and partial cross-sectional view of an engine configured in accordance with another preferred embodiment of the present invention.

FIG. 9 illustrates an engine configured in accordance with another preferred embodiment of the present invention. In this embodiment, the plenum chambers 162, 168 have a compact shape. Specifically, the plenum chambers 162, 168 lie within line C, which extends from the corners of the cam covers 36, 38 of the cylinder head at an angle that is not greater than approximately 30 degrees and preferably less than 15 degrees. This arrangement reduces the size of the engine 24 and the length of the intake pipe 150, which can increase pumping loses. Nevertheless, engine performance can be maintained because of the valve actuating mechanism described above.

Certain objects and advantages of the invention have been described above for the purpose of describing the invention and the advantages achieved over the prior art. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein. Furthermore, although this invention has been described in terms of certain preferred embodiments, other embodiments that will be apparent to those of ordinary skill in the art are intended to be within the scope of this invention. Accordingly, the scope of the invention is intended to be defined by the claims that follow.

What is claimed is:

1. An engine including a valve actuating mechanism comprising a camshaft with at least two adjacent intake cams and at least one exhaust cam, a pair of adjacent, pivotally-supported first and second intake rockers, each intake rocker being pivotal about an intake rocker support and having a cam side arm with a following surface engaged with one of the intake cams for pivoting the intake rocker about the intake rocker support, the first intake rocker also having a valve side arm with an operating portion that directly engages an intake valve of the engine, a first member slideably supported within a first bore of the first intake rocker, a second member slideably supported within a second bore of the first intake rocker, a first passage located within the intake rocker support and in communication with the second bore, the second intake rocker further including a cam side arm with a first engagement surface that engages the first member, the second member selectively engaging the first member when an actuating pressure is supplied to the first passage such that movement of the second intake rocker is transmitted to the first intake rocker, and at least one exhaust rocker having a cam side arm with an exhaust following surface engaged with the exhaust cam for pivoting the exhaust rocker about an exhaust rocker support, the exhaust rocker support lying generally parallel to the intake rocker support and being disposed on a side of the camshaft generally opposite of the intake rocker support.

2. An engine as forth in claim 1, wherein the first and second cams have different lifts.

3. An engine as set forth in claim 1, wherein the cam shaft includes a third intake cam disposed adjacent to the second intake cam and a third intake rocker disposed adjacent to the second intake rocker, the third intake rocker being pivotal about the intake rocker support and having a cam side arm with a following surface engaged with the third intake cam for pivoting the third intake rocker about the intake rocker support, the third intake rocker also having a valve side arm with an operating portion that directly engages another intake valve of the engine, a third member slideably supported within a third bore of the third intake rocker, a fourth member slideably supported within a fourth bore of the third intake rocker, a second passage located within the intake rocker support and in communication with the fourth bore, the second rocker also including a second engagement surface that engages the third member, whereby the fourth member engages the third member when an actuating pressure is supplied to the second passage such that movement of the second intake rocker is transmitted to the third intake rocker.

4. An engine as set forth in claim 3, wherein the first intake cam has a lift L1, the second intake cam has a lift L2 and the third intake cam has a lift L3, and L1<L3<L2.

5. An engine as set forth in claim 1 in combination with an outboard motor, the outboard motor comprising a cowling covering the engine, the engine being disposed in the outboard motor such that an output shaft of the engine rotates about a vertically extending axis.

6. An engine as set forth in claim 1, wherein the intake rocker support and the exhaust rocker support extend along generally parallel axes.

7. An engine as set forth in claim 6, wherein the engine is orientated such that the axes of the intake and exhaust rocker supports extend vertically.

8. An engine as set forth in claim 1, additionally comprising a pair of cylinder banks arranged in a V-type configuration.

9. An engine as set forth in claim 8, wherein at least one of the cylinder banks defines a plurality of cylinders.

10. An engine as set forth in claim 9, additionally comprising an air intake system disposed between the cylinder banks.

11. An engine comprising an output shaft and at least one cylinder having a cylinder axis, the output shaft and the cylinder being arranged such that a central plane that contains the cylinder axis either lies parallel to or contains an axis about which the output shaft rotates, a plurality of ports communicating with the cylinder, a plurality of valves selectively opening and closing the ports, at least a first valve being disposed on a first side of the central plane and at least a second valve being disposed on a second side of the central plane, and a valve actuating mechanism comprising a camshaft having a plurality of cams, a pair of adjacent first and second rockers pivotally supported by a first support, each rocker having a cam side arm with a following surface engaged with one of the cams to pivot the rocker about the first support, the first rocker having a valve side arm with an operator that directly engages the first valve, a first member slideably supported within a first bore of the first rocker, a second member slideably supported within a second bore of the first rocker, a first passage located within the first support and in communication with the second bore, the second rocker further including a first engagement surface that engages the first member, the second member engaging the first member when an actuating pressure is supplied to the first passage such that movement of the second rocker is transmitted to the first rocker, and at least a third rocker having a cam side arm with a following surface engaged with another one of the cams to pivot the third rocker about a second support, the third rocker having a valve side arm with an operator that directly engages the second valve.

12. An engine as set forth in claim 11, wherein the first and second supports lie on opposite sides of the central plane.

13. An engine as set forth in claim 12, wherein the first and second supports extend along generally parallel axes.

14. An engine as set forth in claim 13, wherein the engine is orientated such that the axes of the first and second supports extend vertically.

15. An engine as set forth in claim 11, wherein the cam shaft includes more cams per cylinder than valves per cylinder.

16. An engine as set forth in claim 11, wherein the cams that engage the first and second rocker have different lifts.

17. An engine as set forth in claim 11, wherein a third valve is located on the first side of the central plane, and the valve actuating mechanism includes a fourth rocker that is pivotally supported by the first support, the fourth rocker has cam side arm with a following surface engaged with one of the cams to pivot the fourth rocker about the first support, the fourth rocker also has a valve side arm with an operator that directly engages the third valve, a third member is slideably supported within a first bore of the fourth rocker, a fourth member is slideably supported within a second bore of the fourth rocker, and a second passage is located within the first support and is in communication with the second bore of the fourth rocker, the second rocker further including a second engagement surface that engages the third member, whereby the fourth member engages the third member when an actuating pressure is supplied to the second passage such that movement of the second rocker is transmitted to the fourth rocker.

18. An engine as set forth in claim 17, wherein the cam engaged with the first rocker has a first lift L1, the cam engaged with the second rocker has a second lift L2 and the cam engaged with the fourth rocker has a third lift L3, and these cams are configured such that L1<L3<L2.

19. An engine as set forth in claim 17, wherein the first member is biased to engage the first engagement surface of the second rocker, the third member is biased to engage the second engagement surface of the second rocker, and the first and third members selectively slide within in the respective bores when actuated by the respective engagement surfaces of the second rocker.

20. An engine as set forth in claim 19, wherein the second member locks the first member into a stationary position relative to the first bore of the first rocker when the actuating pressure is applied to the second bore of the first rocker through the first passage.

21. An engine as set forth in claim 19, wherein the fourth member locks the third member into a stationary position relative to the first bore of the fourth rocker when the actuating pressure is applied to the second bore of the fourth rocker through the second passage.

22. An engine as set forth in claim 11, wherein the first member is biased to engage the first engagement surface of the second rocker.

23. An engine as set forth in claim 22, wherein the first member slides within the first bore under a first operating condition and is locked into a stationary position relative to the first bore under a second operating condition by the second member when the actuating pressure is applied to the second bore through the first passage.

* * * * *